US005129214A

United States Patent [19]

Schubert

[11] Patent Number: 5,129,214

[45] Date of Patent: Jul. 14, 1992

[54] DEVICE FOR PLACING CHOCOLATES INSERTED INTO PAPER CUPS WITH UPRIGHT, PLEATED EDGES INTO THE BOTTOM PORTION OF CANDY BOXES

[75] Inventor: Gerhard Schubert, Crailsheim, Fed. Rep. of Germany

[73] Assignee: Gerhard Schubert GmbH, Crailsheim, Fed. Rep. of Germany

[21] Appl. No.: 620,781

[22] Filed: Dec. 3, 1990

[30] Foreign Application Priority Data

Dec. 28, 1989 [DE] Fed. Rep. of Germany ..... 3943213

[51] Int. Cl.[5] ..... B65B 35/34

[52] U.S. Cl. ..... 53/531; 53/156; 53/525; 414/417

[58] Field of Search ..... 53/154, 155, 156, 246, 53/237, 238, 525, 529, 531, 537; 414/417; 294/172

[56] References Cited

U.S. PATENT DOCUMENTS

| | | | |
|---|---|---|---|
| 2,886,927 | 5/1959 | Fisk | 53/156 |
| 2,907,158 | 10/1959 | Labrozzi et al. | 53/525 |
| 2,935,216 | 5/1960 | Patt | 414/417 |
| 3,001,344 | 9/1961 | Morton et al. | 53/529 |
| 3,244,123 | 4/1966 | Pestritto et al. | 414/417 X |
| 3,601,948 | 8/1971 | Ludwig . | |
| 4,048,780 | 9/1977 | Chenevard | 53/543 X |

FOREIGN PATENT DOCUMENTS

| | | | |
|---|---|---|---|
| 1229442 | 11/1966 | Fed. Rep. of Germany . | |
| 2648721 | 4/1977 | Fed. Rep. of Germany . | |
| 2601832 | 7/1977 | Fed. Rep. of Germany . | |
| 2748138 | 5/1979 | Fed. Rep. of Germany . | |
| 3507656 | 9/1986 | Fed. Rep. of Germany . | |
| 255106 | 2/1968 | U.S.S.R. | 414/417 |
| 575274 | 10/1977 | U.S.S.R. | 53/525 |
| 599791 | 3/1978 | U.S.S.R. | 53/525 |

*Primary Examiner*—Robert L. Spruill
*Assistant Examiner*—Daniel B. Moon
*Attorney, Agent, or Firm*—Nies, Kurz, Bergert & Tamburro

[57] ABSTRACT

A device for placing chocolates inserted into paper cups with upright, pleated edges into the bottom portion of candy boxes, with cartridges moved by a conveyor belt and having recesses or the like to accomodate the paper cups; a device for inserting the paper cups into the recesses in the cartridges; a device for inserting the chocolates into the paper cups and a device for transferring the paper cups filled with chocolates to the bottom portion of a candy box, wherein said cartridges have grooves extending from one side to the other side, with bridges disposed therebetween, with lateral indentations disposed facing one another at the locations of said paper cups.

5 Claims, 1 Drawing Sheet

DEVICE FOR PLACING CHOCOLATES INSERTED INTO PAPER CUPS WITH UPRIGHT, PLEATED EDGES INTO THE BOTTOM PORTION OF CANDY BOXES

BACKGROUND OF THE INVENTION

This invention refers to a device for placing chocolates inserted into paper cups with upright, pleated edges into the bottom portion of candy boxes, with cartridges moved by a conveyor belt and having recesses or the like to accommodate the paper cups; a device for inserting the paper cups into the recesses in the cartridges; a device for inserting the chocolates into the paper cups and device for transferring the paper cups filled with chocolates to the bottom portion of a candy box.

Ordinarily, inserts consisting of deep-drawn plastic sheets are placed in the bottom portion of candy boxes, which inserts have recess-like depressions for accommodating the chocolates. Such plastic inserts place a substantial burden on household garbage and the environment.

To avoid this, it is suggested that instead of the plastic insets receiving the chocolates, paper cups with upright, pleated edges be used, which are known per se and are already used to accommodate chocolates, albeit primarily in manual production of chocolates and packaging them by hand. Using cartridges to package chocolates in cups accommodating the same, with holes or recesses into which said cups are inserted being located in said cartridges, has already become known. To place the cups filled with chocolates into a candy box, however, it is necessary to lift them with a vertically movable piston from the holes or recesses in the cartridge, in order to then insert them into the bottom portion of a candy box. However, these known devices have a relatively complex construction and are prone to breakdowns, resulting in operational disruptions of the packaging plant and in rejects.

SUMMARY OF THE INVENTION

Therefore, the invention is based on the task of creating a device of the type in question, which is more simply and less complexly constructed and which permits efficient, high-speed packaging of chocolates inserted into paper cups.

For the solution of this task it is suggested that the cartridges to be used have grooves extending from one side to the other, with bridges disposed therebetween, wherein lateral indentations, one facing the other, are arranged in said bridges at the locations of the paper cups and the paper cups extend with their upright, pleated edges into said indentations and hence are also positioned at the respective place in question.

Additional features of the device according to the invention can be found in the subclaims and the following description of a preferred embodiment shown in FIGS. 1 and 2 of the drawings.

DETAILED DESCRIPTION OF THE DRAWINGS

Figure 1:
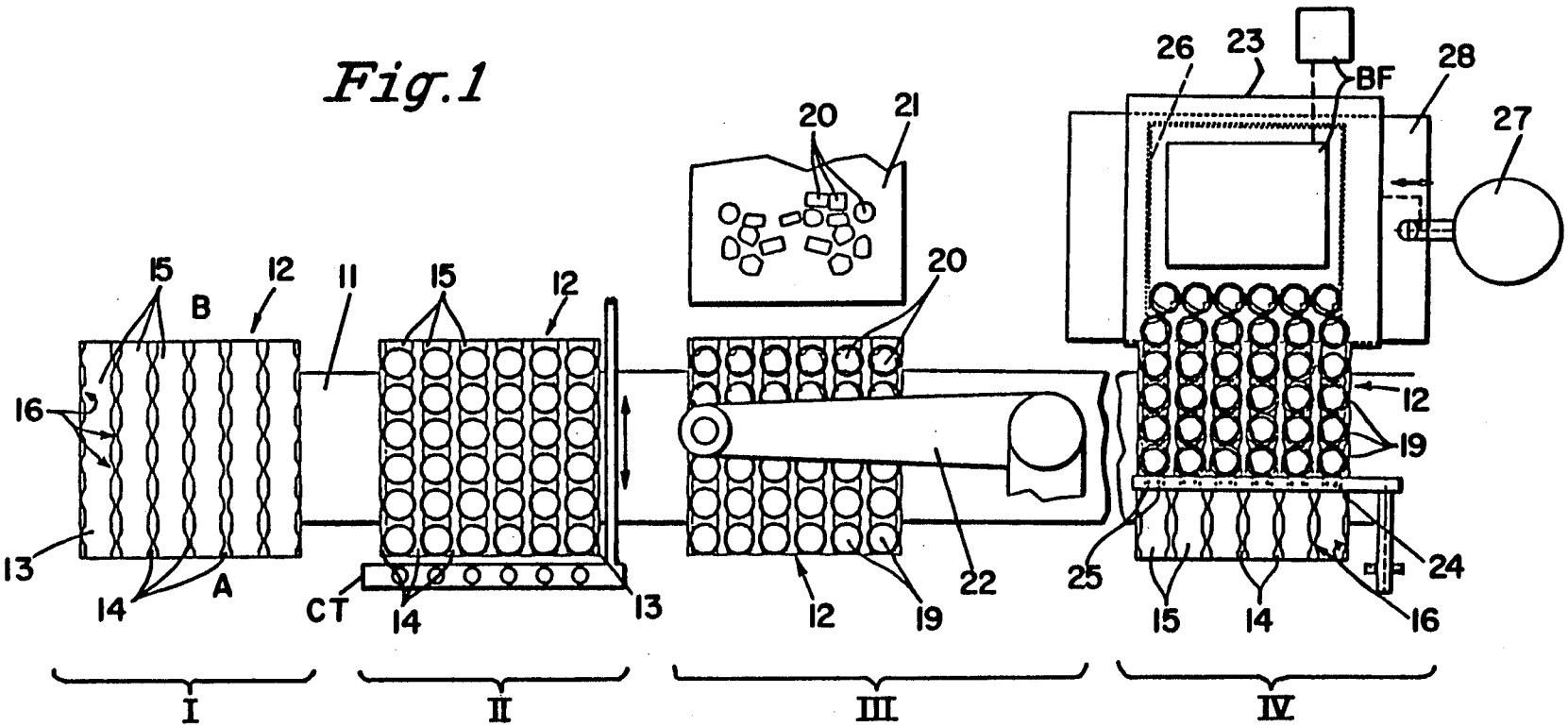
FIG. 1 shows a plan view of the device according to the invention, for placing chocolates inserted into paper cups with upright, pleated edges in the bottom portion of candy boxes.
Figure 2:
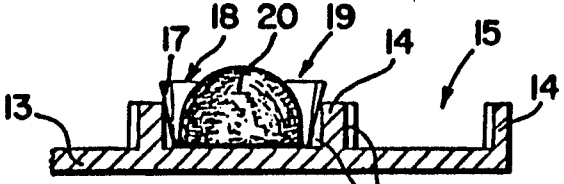
FIG. 2 shows a cross section through a portion of a cartridge according to the invention.

As shown in FIG. 1, the device has a conveyor belt 11 by which the cartridges 12 laid thereupon at station I in a specified spaced relationship to one another are advanced.

The cartridges 12 have a bottom 13 bearing strip-like bridges 14 arranged in parallel relation to one another and extending from the one side A of the cartridge 12 to the opposite side B, so that grooves 15 open toward the sides A and B are formed between them. Indentations 16 spaced evenly apart are located in the bridges 14, said indentations serving to accommodate a part 17 of the upright, pleated edge 18 of the paper cups 19. The cartridges 12 are deposited onto the conveyor belt 11 in such a way that the bridges 14 and/or the grooves 15 extend transversely to the longitudinal direction and direction of movement of the conveyor belt 11.

At the paper cup loading station II, the paper cups 19 are inserted into the grooves 15 between the bridges 14, with their marginal portion 17 extending into the indentations 16 in the bridges 14. The cups 19 are thereby precisely positioned. Apparatus for accomplishing the placement of paper cups into precise positions in the cartridge 12 at station II is well-known in the industry and is not specifically disclosed herein. An example of suitable mechanism with pick-up heads to enable pick-up, transfer and precise placement of a multiple number of cups into place between the bridges 14 in a cartridge 12 located at station II is shown and described in expired U.S. Pat. No. 3,283,471 to F. J. THURSTON et al. A diagramatic representation of such a cup transfer device referenced CT is shown at station II in FIG. 1. At the chocolate-filling III, chocolates 20 are advanced by a conveyor belt 21. There, a chocolate 20 is placed in each one of the paper cups 19 carried by the cartridge 12. A robot device 22 known per se serves this purpose, said robot taking the chocolates 20 from the conveyor belt 21 and bringing them to the individual paper cups 19, depositing them into the paper cups.

After all paper cups 19 have been filled with chocolates 20 at station III, the cartridge 12 with filled cups is fed to the transfer station IV. A calibrating frame 23 open on one side is located at the station IV to one side of the belt conveying the cartridges 12. The open side of the frame 23 faces the cartridge 12. At this transfer station IV all of, the paper cups 19 filled with chocolates 20, and carried in a cartridge 12, are shifted by a bar 24, as a group, transverse to the path of belt 11 along the grooves 15 between the bridges 14 of the cartridge 12. For this purpose, prongs 25 disposed on the bar 24 will move into abutment with the respective rearmost paper cups 19 in the grooves 15 of cartridge 12, will shaft all of the cups with chocolates along the grooves into the calibrating frame 23. The prongs 25 during the shifting of bar 24 project down into the grooves 15.

The interior of the calibrating frame 23 corresponds in size to the interior of the bottom portion of the chocolate box to be filled, into which the paper cups 19 containing chocolates are later inserted; however, it is also smaller than the base surface described by the paper cups 19 resting on the cartridge 12. The paper cups 19 are crowded together while being shifted into the calibrating frame 23.

To avoid a pile-up of the chocolate-filled paper cups 19 during the shifting, they are covered by a preferably transparent coverplate 26 during the shifting operation.

To facilitate the shifting of the paper cups 19 and their crowding together to a narrower space, the calibrating frame 23 can be caused to oscillate, preferably transversely to the feed direction, for instance by a crank mechanism 27 or in any other suitable manner. It is also advantageous to cause the base plate 28 beneath the calibrating frame 23 to oscillate.

As soon as the chocolate-filled paper cups 19 in one cartridge 12 are disposed in the calibrating frame 23, they are transferred to the bottom portion of a candy box in the usual way with known equipment. One such piece of known equipment is shown and described in expired U.S. Pat. No. 3,001,344 to D.C. Morton et al. A mechanism for moving the group of filed cups into a box below the calibrating frame is diagramatically shown and referenced as BF at the transfer station IV in FIG. 1.

What is claimed is:

1. A device for placing chocolates inserted into paper cups with upright, pleated edges into the bottom portion of candy boxes, said device including a conveyor belt and cartridges moved by said conveyor belt, said cartridges having recesses to accommodate the paper cups; a transfer apparatus for inserting the paper cups into the recesses in the cartridges; an insert apparatus for inserting the chocolates into the paper cups and a mechanism for transferring the paper cups filled with chocolates into the bottom portion of a candy box; said cartridges (12) used in said device being substantially rectangular in plan form with a bottom, two sets of opposed sides and having parallel bridges (14) on said bottom with open ended grooves therebetween, said grooves (15) constituting said recesses and extending parallel with each other between the cartridge sides (A) and (B) of one set of said opposed sides and said bridges (14) disposed between said grooves include side walls with spaced-apart lateral indentations (16) disposed facing one another across said grooves and providing precise locations along said recesses, each of which locations of a pair of opposed indentations comprising means to receive one of the paper cups (19).

2. A device according to claim 1, further including a calibrating frame (23) with four sides and open on one side for receiving said paper cups (19) filled with chocolates (20), a transfer station (IV) beside the conveyor belt (11) and including said calibrating frame (23) with its open side facing said conveyor belt and facing the open ends of the grooves on a cartridge, on said belt, which carries chocolate filled paper cups; said transfer station further including shifting means including a bar (24) disposed parallel to the direction of movement of said conveyor belt and adapted to be shifted normally to said direction of movement of said belt and above a cartridge on said belt, said bar having depending prongs (25) adapted to depend into said grooves (15) of said cartridge (12), with said prongs, when said bar is shifted, engaging and shifting said filled paper cups (19) along said grooves (15) and subsequently out of the cartridge into said calibrating frame (23) through its open side.

3. A device according to claim 2, wherein means at said transfer station includes a transparent coverplate (26) which is adapted to be placed over said calibrating frame and above the chocolate-filled paper cups (19) as the filled cups are shifted from a said cartridge into said calibrating frame.

4. A device according to claim 2, further including an oscillating means connected to said calibrating frame (23) to oscillate said calibrating frame horizontally and at least transversely to the feed direction of the filled paper cups (19) as the filled cups are shifted from a cartridge laterally into said calibrating frame.

5. A device according to claim 2, wherien said transfer station includes a bottom plate (28) beneath said calibrating frame (23) and said oscillating means is connected to said bottom plate to oscillate said bottom plate as the filled cups are shifted into said calibrating frame.

* * * * *